US007950362B2

(12) United States Patent
Kim et al.

(10) Patent No.: US 7,950,362 B2
(45) Date of Patent: May 31, 2011

(54) VARIABLE VALVE LIFT APPARATUS

(75) Inventors: Back Sik Kim, Osan (KR); Ingee Suh, Yongin (KR); Dong Hee Han, Seoul (KR); Yooshin Cho, Seoul (KR); Wootae Kim, Suwon (KR); Chun Woo Lee, Hwaseong (KR); Hyung Ick Kim, Gumpo (KR); Myungsik Choi, Seoul (KR); Dae Sung Kim, Hwaseong (KR); Kyoung Pyo Ha, Suwon (KR)

(73) Assignee: Hyundai Motor Company, Seoul (KR)

( * ) Notice: Subject to any disclaimer, the term of this patent is extended or adjusted under 35 U.S.C. 154(b) by 386 days.

(21) Appl. No.: 12/276,130

(22) Filed: Nov. 21, 2008

(65) Prior Publication Data

US 2009/0241876 A1 Oct. 1, 2009

(30) Foreign Application Priority Data

Mar. 27, 2008 (KR) ..... 10-2008-0028602

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2006/0075982 A1 * 4/2006 Fujita et al. ..... 123/90.16
* cited by examiner

*Primary Examiner* — Zelalem Eshete
(74) *Attorney, Agent, or Firm* — Morgan, Lewis & Bockius LLP

(57) ABSTRACT

A variable valve lift apparatus includes an input cam disposed to a input shaft, a valve opening unit, a control shaft parallel to the input shaft, an input link rotatably coupled to the control shaft and contacting the input cam, a control link connected with the input link and eccentrically connected to the control shaft, a connecting link connected with the control link, and a lift arm that is rotatably coupled to the control shaft, is connected with the connecting link, and drives the valve opening unit.

20 Claims, 10 Drawing Sheets

VARIABLE VALVE LIFT APPARATUS

CROSS-REFERENCE TO RELATED APPLICATION

The present application claims priority to Korean Patent Application No. 10-2008-0028602 filed Mar. 27, 2008, the entire contents of which application is incorporated herein for all purposes by this reference.

BACKGROUND OF THE INVENTION

1. Field of the Invention

The present invention relates to a continuous variable valve lift apparatus. More particularly, the present invention relates to a continuous variable valve lift apparatus that can adjust a valve lift amount in response to an operational state of an engine.

2. Description of Related Art

A typical combustion chamber of an automotive engine is provided with an intake valve for supplying an air/fuel mixture and an exhaust valve for expelling burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of a gas that is being introduced or exhausted.

If the valve lift apparatus is designed for low driving speeds, the valve open time and amount are not sufficient for high speeds. On the other band, if the valve lift apparatus is designed for high speeds, the opposite is true.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuous variable valve lift apparatus that may realize various lift operation ranges. Various aspects of the present invention may provide for a continuous variable valve lift apparatus that may realize a mirror design and include a cam carrier so that mass production may be realized without a high cost. Various aspects of the present invention may provide for a continuous variable valve lift apparatus that may use wall portions of a cam carrier, may enhance assembling characteristics thereof, and may easily adjust declination of valves.

One aspect of the present invention is directed to a continuous variable valve lift apparatus that may include an input cam connected to an input shaft, a valve opening unit, a control shaft disposed in parallel to the input shaft, an input link rotatably coupled to the control shaft and contacting the input cam, a control link, one end of which is rotatably coupled to the input link and the other end of which is eccentrically coupled to the control shaft, a connecting link, one end of which is connected with the other end of the control link, and/or a lift arm, one end of which is rotatably coupled to the control shaft and the other end of which is rotatably coupled to the other end of the connecting link, the lift arm driving the valve opening unit.

The input link may include a first member, one end of which is rotatably coupled to the control shaft, a second member, one end of which is rotatably coupled to the other end of the first member, and the other end of which is rotatably coupled to the other end of the control link, and/or a roller rotatably coupled to the one end of the second member or the other end of the first member, and contacting the input cam. A protrusion portion may be formed to the one end of the first member and a lost motion spring is configured to bias the protrusion portion toward the input link for supplying restoring force to the input link.

The other end of the second member, the other end of the control link, and the one end of the connecting link may be coupled by a first connecting pin.

The other end of the connecting link and the other end of the lift arm may be coupled by a second connecting pin.

The variable valve lift apparatus may further include a control portion coupled to the control shaft and controlling rotation angle thereof.

The control portion may include a control motor and a worm gear, wherein the worm gear is coupled to an end of the control shaft.

The one end of the control link may include an inner race rotatably coupled to inner portion thereof, and rotation center of the inner race is configured to be eccentric with rotation center of the one end of the control link with a predetermined distance. The inner race of the control link may be connected to the control shaft.

Another aspect of the present invention is directed to a variable valve lift apparatus that may include an input shaft, an input cam connected to the input shaft, a valve opening unit, a control shaft disposed in parallel to the input shaft, a control portion controlling rotation angle of the control shaft, an input link rotatably coupled to the control shaft and contacting the input cam, a control link, one end of which is rotatably coupled to the input link and the other end of which is eccentrically coupled to the control shaft, a connecting link, one end of which is connected with the other end of the control link, and/or a lift arm, one end of which is rotatably coupled to the control shaft and the other end of which is rotatably coupled to the other end of the connecting link, the lift arm driving the valve opening unit, wherein a cam carrier supports the input shaft and the control shaft.

The input link may include a first member, one end of which is rotatably coupled to the control shaft, a second member, one end of which is rotatably coupled to the other end of the first member, and the other end of which is rotatably coupled to the other end of the control link, and/or a roller rotatably coupled to the one end of the second member or the other end of the first member, and contacting the input cam. A protrusion portion may be formed to the one end of the first member and a lost motion spring is configured to bias the protrusion portion toward the input link for supplying restoring force to the input link.

The control portion may include a control motor and a worm gear wherein the worm gear is coupled to an end of the control shaft. The one end of the control link may include an inner race rotatably coupled to inner portion thereof, and rotation center of the inner race is configured to be eccentric with rotation center of the one end of the control link with a predetermined distance. The inner race of the control link may be connected to the control shaft.

A first wall portion is formed to the cam carrier, and the input link, the control link, and the connecting link may be connected by the first connecting pin, wherein the first connecting pin is disposed bear to the first wall portion and thus prevented from separation by the first wall portion.

A second wall portion may be formed to the cam carrier, and the connecting link and the lift arm are connected by the second connecting pin, wherein the second connecting pin is disposed near to the second connecting pin and thus prevented from separation by the second connecting pin.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
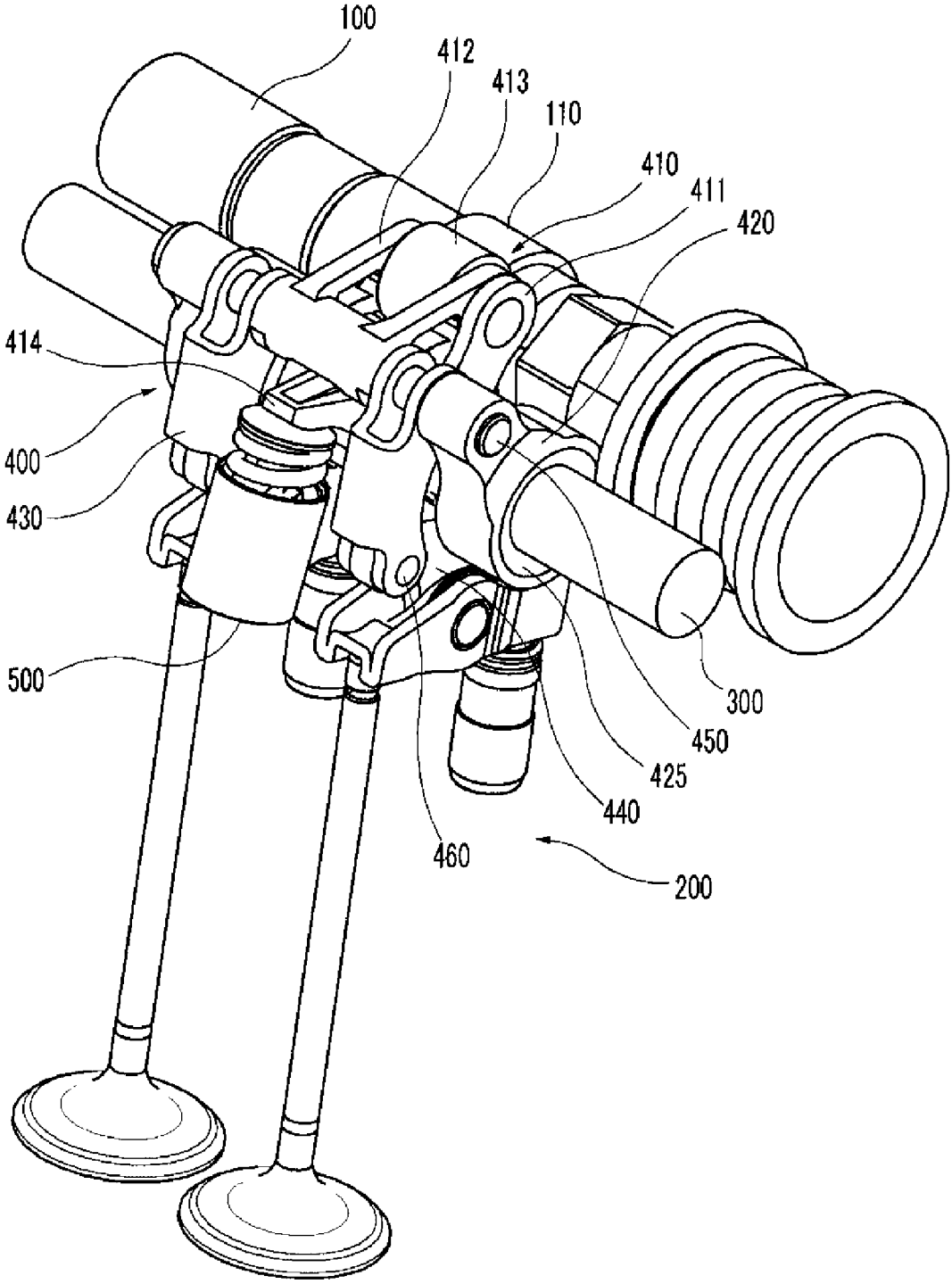
FIG. 1 is a perspective view of an exemplary variable valve lift apparatus according to the present invention.
Figure 2:
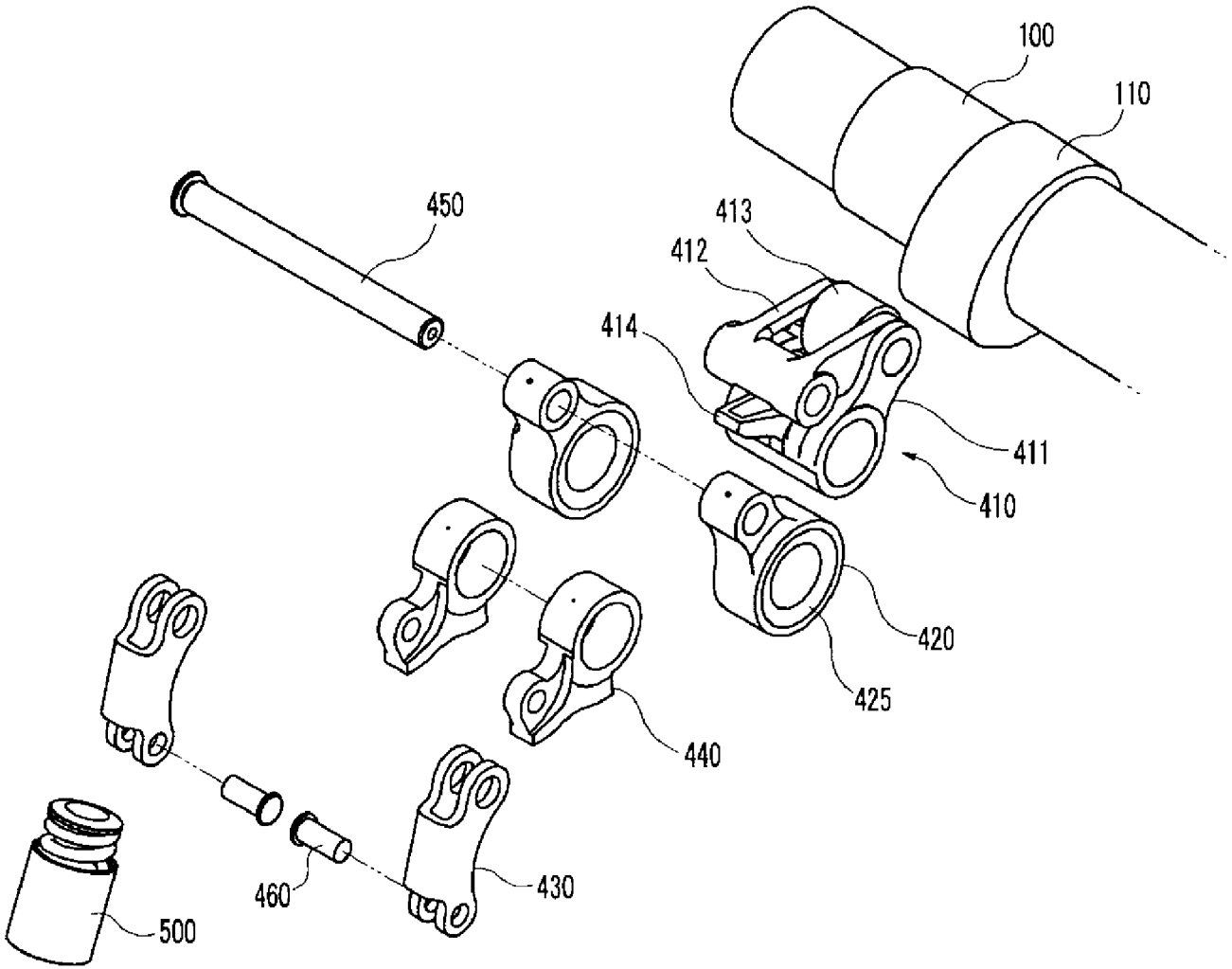
FIG. 2 is a partial exploded view of an exemplary variable valve lift apparatus according to the present invention.

FIG. 1 is a perspective view of a variable valve lift apparatus according to various embodiments of the present invention, and FIG. 2 is a partial exploded view of a variable valve lift apparatus according to various embodiments of the present invention.

Referring to FIG. 1 and FIG. 2, a variable valve lift apparatus according to various embodiments of the present invention includes an input cam 110 disposed to an input shaft 100, a valve opening unit 200, a control shaft 300 parallel to the input shaft 100, and a connecting portion 400 that receives rotation of the input cam 110 and drives the valve opening unit 200. One will appreciate that the control shaft may be eccentric in various embodiments.

The connecting portion 400 includes an input link 410 that contacts the input cam 110 and is rotatably coupled to the control shaft 300, a control link 420 that is connected to the input link 410 and eccentrically connected to the control shaft 300, connecting link 430 that is connected to the control link 420, and a lift arm 440 that is connected to the connecting link 430, rotatably coupled to the control shaft 300, and drives the valve opening unit 200.

The input link 410 includes a first member 411 connected with the control shaft 300, a second member 412 connected with the first member 411, and a roller 413 contacting the input cam 110.

A protrusion portion 414 is formed to the input link 410, and a lost motion spring 500 contacting the protrusion portion 414 is disposed for supplying restoring force to the input link 410.

The second member 412 of the input link 410, the control link 420, and the connecting link 430 are coupled by a first connecting pin 450.

The connecting link 430 and the lift arm 440 are coupled by a second connecting pin 460.

The control link 420 includes an inner race 425 rotatably coupled to inner portion of the control link 420. The inner race 425 is connected to the control shaft 300. Accordingly as the control shaft 300 rotates, the inner race 425 connected to the control shaft 300 converts the rotation of the control shaft 300 into an eccentric rotation for the control link so that the relative distance between the control link 420 and the input shaft 100 can be controlled.

Hereinafter, referring FIG. 3 to FIG. 6, an operation of the variable valve lift apparatus according to various embodiments of the present invention will be explained.

Figure 3:
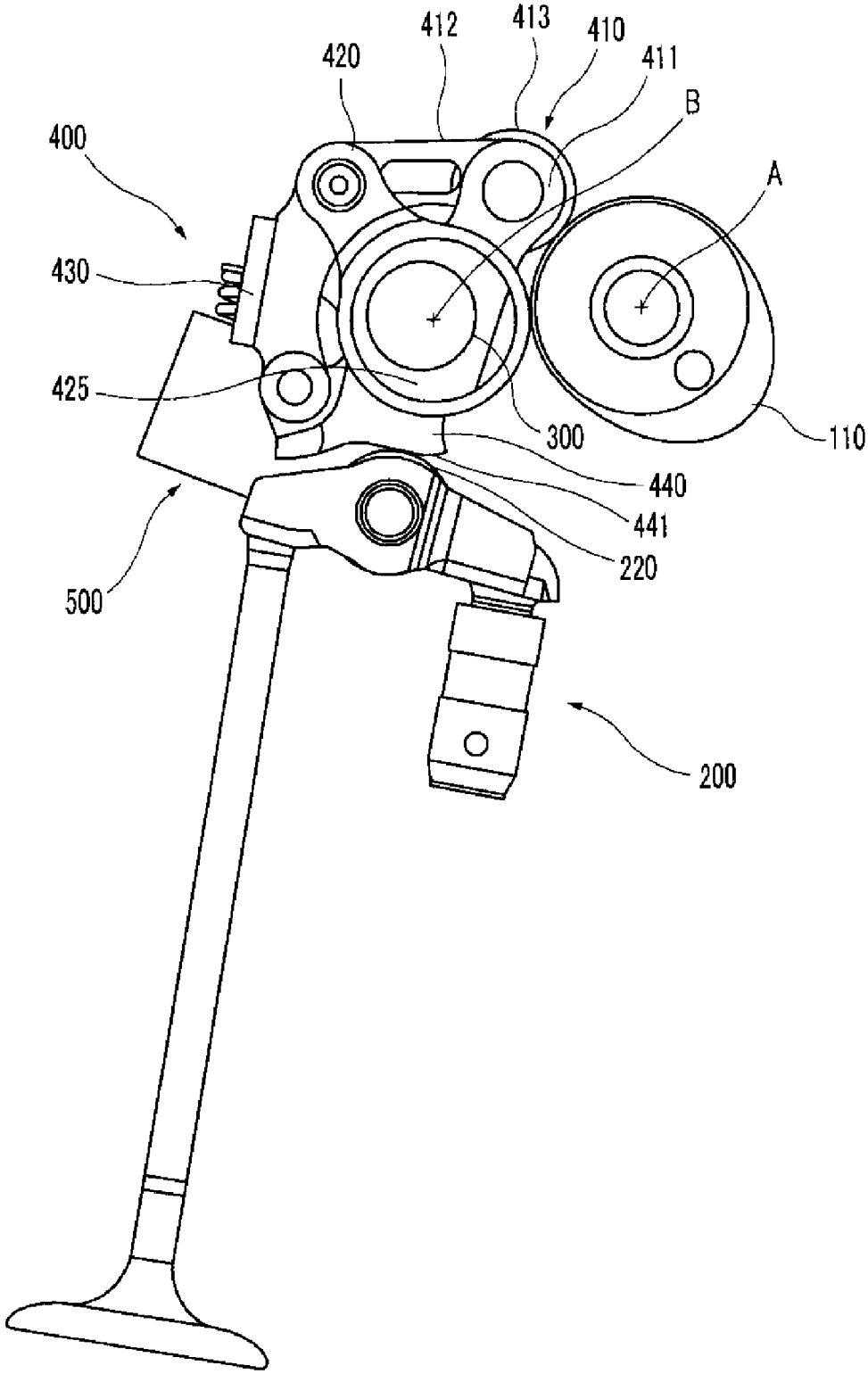
FIG. 3 is a drawing showing a valve in a closed state in high lift mode of an exemplary variable valve lift apparatus according to the present invention.
Figure 4:
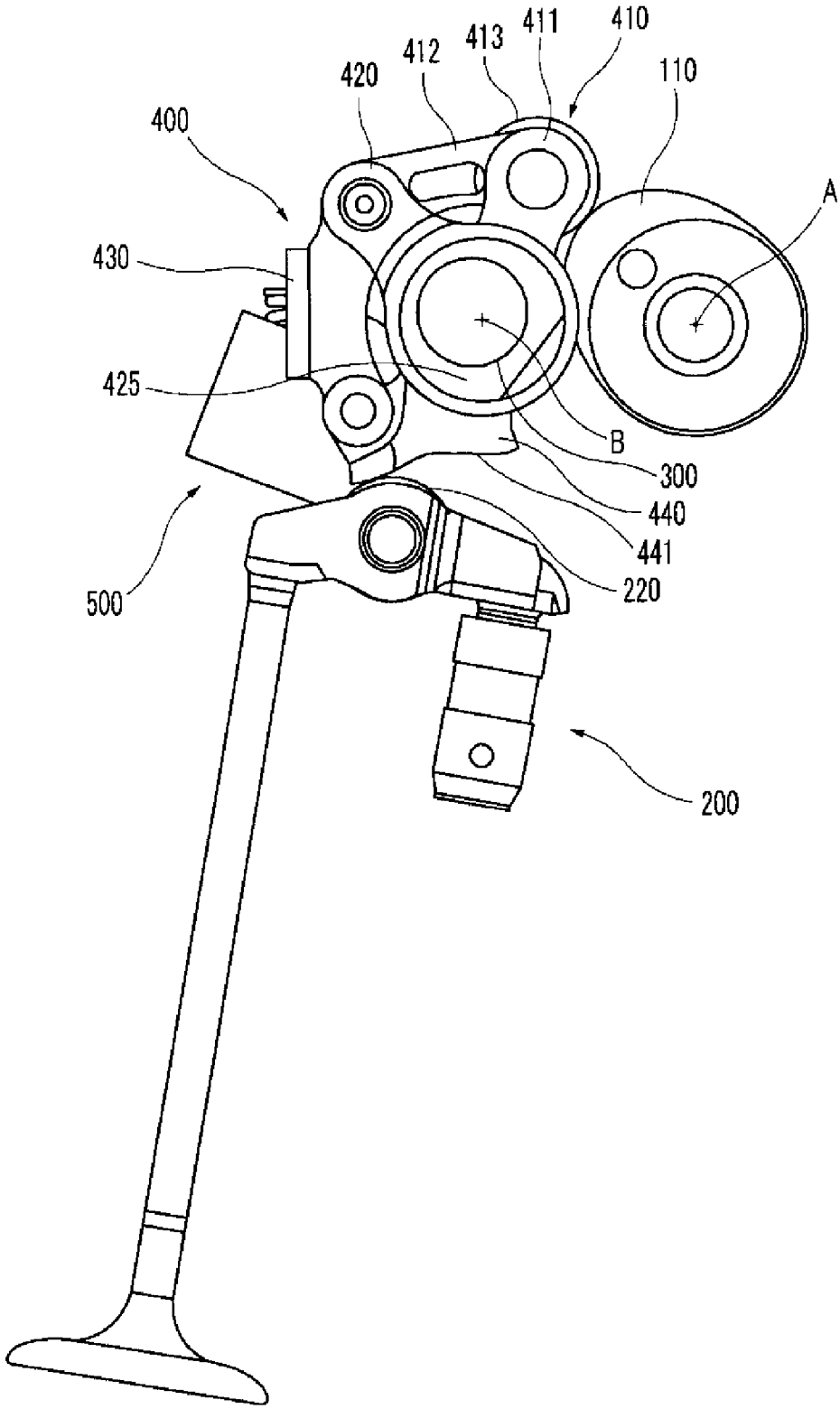
FIG. 4 is a drawing showing a valve in an opened state in high lift mode of an exemplary variable valve lift apparatus according to the present invention.

FIG. 3 and FIG. 4 are drawings of a variable valve lift apparatus according to various embodiments of the present invention showing a valve in a closed state and an opened state in high lift mode, respectively.

Figure 5:
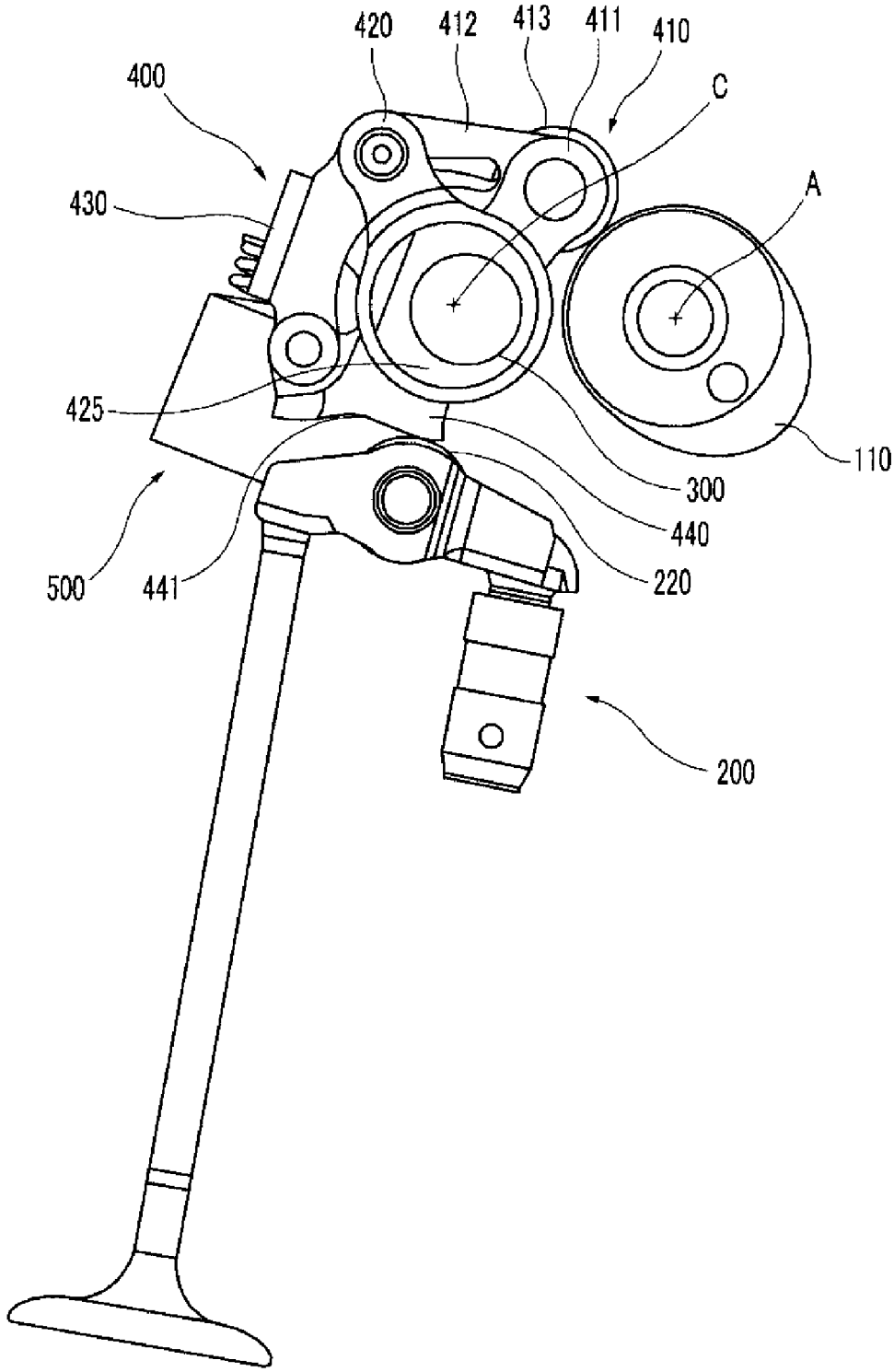
FIG. 5 is a drawing showing a valve in a closed state in low lift mode of an exemplary variable valve lift apparatus according to the present invention.
Figure 6:
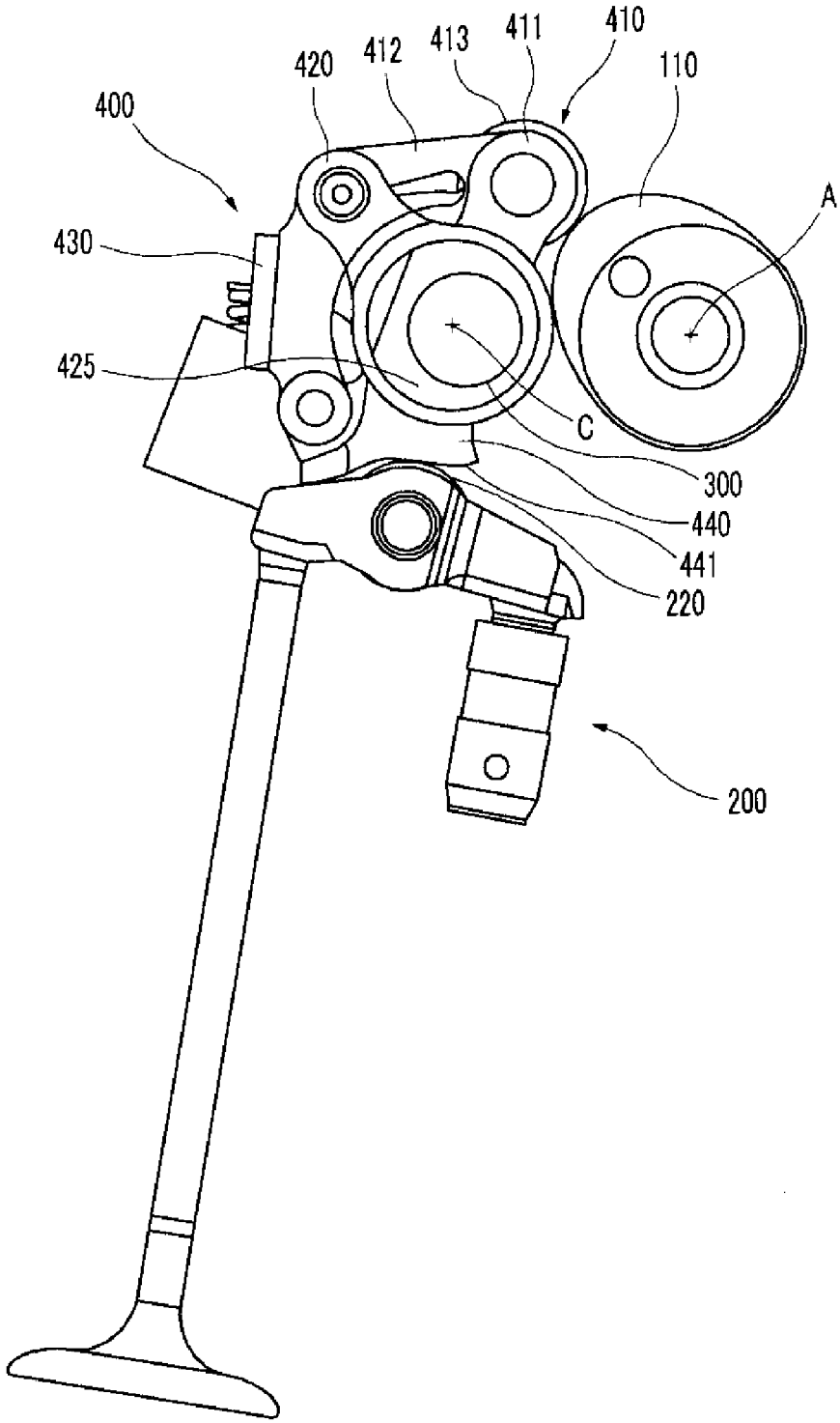
FIG. 6 is a drawing showing a valve in an opened state in low lift mode of an exemplary variable valve lift apparatus according to the present invention.

FIG. 5 and FIG. 6 are drawings of a variable valve lift apparatus according to various embodiments of the present invention showing a valve in a closed state and an opened state in a low lift mode, respectively.

In FIG. 3 to FIG. 6, "A" indicates a rotation center of the input cam 110, "B" indicates a center of the control link 420 in high lift mode, and "C" indicates a center of the control link 420 in low lift mode.

Referring to FIG. 3 and FIG. 4, in high lift mode, a relative distance between the rotation center of the input cam A and the center B of the control link 420 is close according to a rotation of the control shaft 300.

Referring to FIG. 5 and FIG. 6, in low lift mode, a relative distance between the rotation center of the input cam A and the center C of the control link 420 is more distant according to a rotation of the control shaft 300.

Comparing high lift mode and low lift mode, in low lift mode, an angle between the input link 410 and the lift arm 440 is relatively reduced.

That is, a contact position of a needle bearing 220 and a lift arm contact portion 441 is changed according to rotation of the control shaft 300, so that in high lift mode and low lift mode, valve timing and valve lift are changed in response to a cross-section of the lift arm contact portion 441.

In FIG. 3 to FIG. 6, the high lift mode and the low lift mode are shown, however, continuous valve lift change is available according to an angle change of the control shaft 300.

A cross-section of the lift arm contact portion 441 may be changed according to a relative distance between the rotation center A of the input cam 110 and the center B or C of the control link 420, required valve lift, maximum or minimum valve lift, and so on, and determination of the cross-section of the lift arm contact portion 441 may be executed by a skilled person in the art with the description, so a detailed explanation will be omitted.

Figure 7:
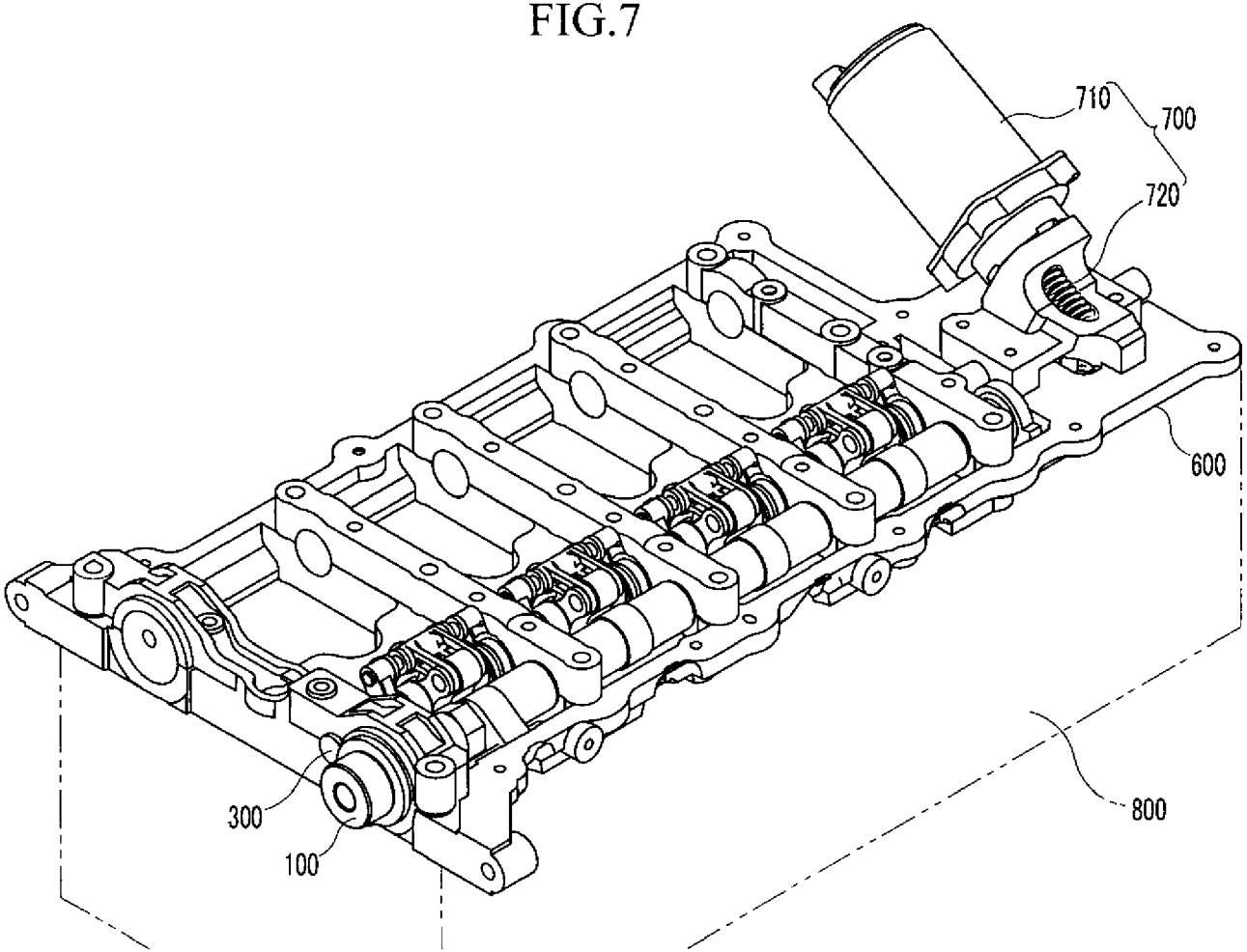
FIG. 7 is a perspective view of an exemplary variable valve lift apparatus according to the present invention including a control portion and a cam carrier.

FIG. 7 is a perspective view of a variable valve lift apparatus according to various embodiments of the present invention including a control portion and a cam carrier.

Referring to FIG. 7, in the variable valve lift apparatus according to various embodiments of the present invention, the input shaft 100 and the control shaft 300 are supported by a cam carrier 600.

The cam carrier 600 is connected with a cylinder head 800 so that modulization of a variable valve lift apparatus may be achieved and the design may be easily changed.

The control shaft 300 can be rotated by a control portion 700, and the control portion 700 includes a control motor 710 and a worm gear 720.

Controlling of the angle of the control shaft 300 according to engine operation conditions can be executed by a skilled person in the art, so a detailed explanation will be omitted.

Figure 8:
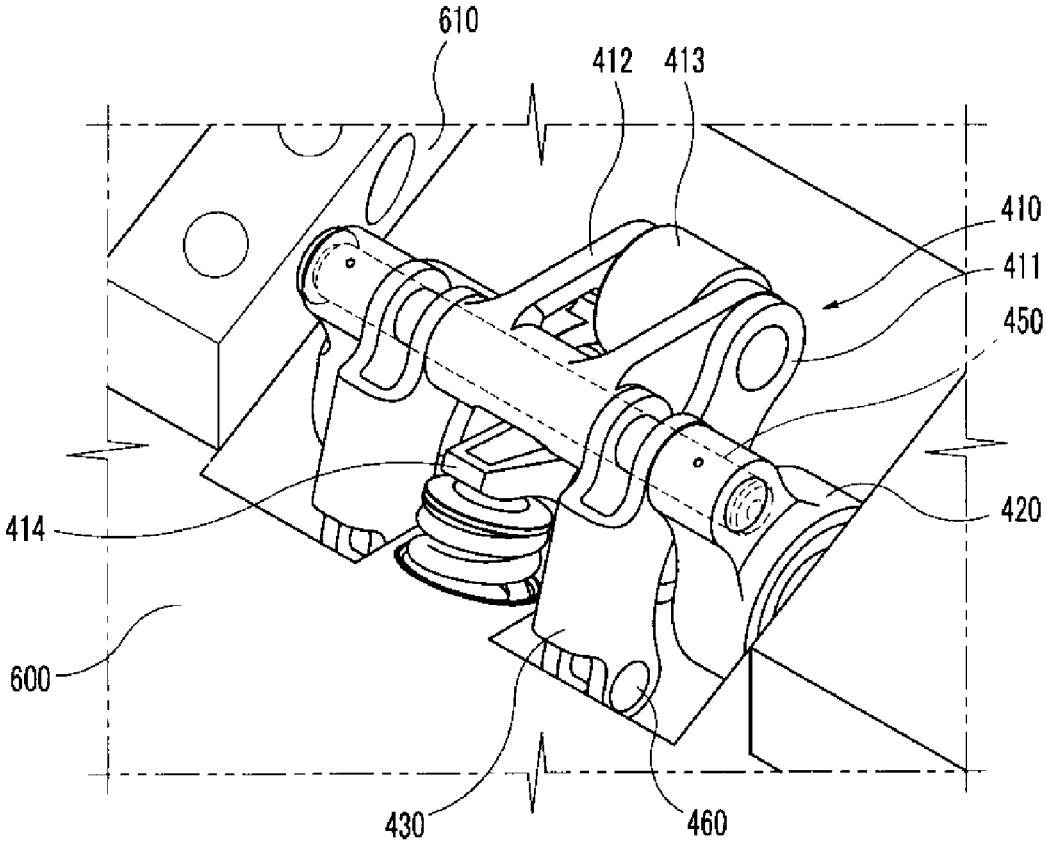
FIG. 8 is a perspective view of an exemplary variable valve lift apparatus according to the present invention showing connection by a connecting pin.

FIG. 8 is a perspective view of a variable valve lift apparatus according to various embodiments of the present invention showing connection by a connecting pin.

Figure 9:
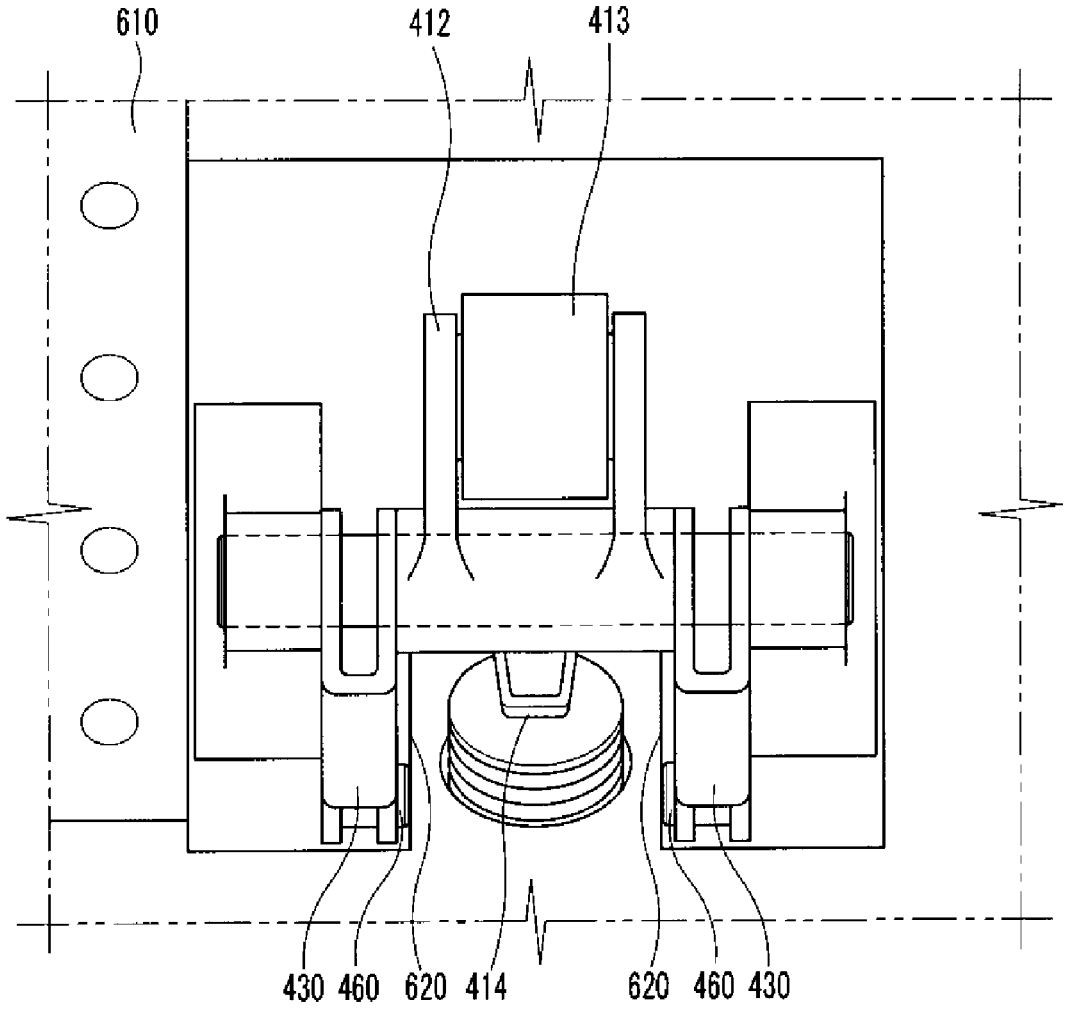
FIG. 9 is a top plan view of an exemplary variable valve lift apparatus according to the present invention showing connection by a connecting pin.

FIG. 9 is a top plan view of a variable valve lift apparatus according to various embodiments of the present invention showing connection by a connecting pin.

A first wall portion 610 is formed to the cam carrier 600, and the input link 410, the control link 420, and the connecting link 430 are connected by the first connecting pin 450. Separation of the first connecting pin 450 may be prevented by the first wall portion 610 in an operation state of the variable valve lift apparatus.

A second wall portion 620 is formed to the cam carrier 600, and the connecting link 430 and the lift arm 440 are connected by the second connecting pin 460. Separation of the second connecting pin 460 may be prevented by the second wall portion 620 in an operation state of the variable valve lift apparatus.

Using the first connecting pin 450 and the second connecting pin 460, assembly and disassembly are easily executed and separation may be prevented by the first wall portion 610 and the second wall portion 620 in operation so that surplus elements for connecting the first connecting pin 450 and the second connecting pin 460 are not needed.

So, the overall number of elements may be reduced, and production cost and maintaining cost may be reduced.

The connecting link 430 may be easily separated, so that deviation that may be generated in manufacturing process may be prevented.

Figure 10:
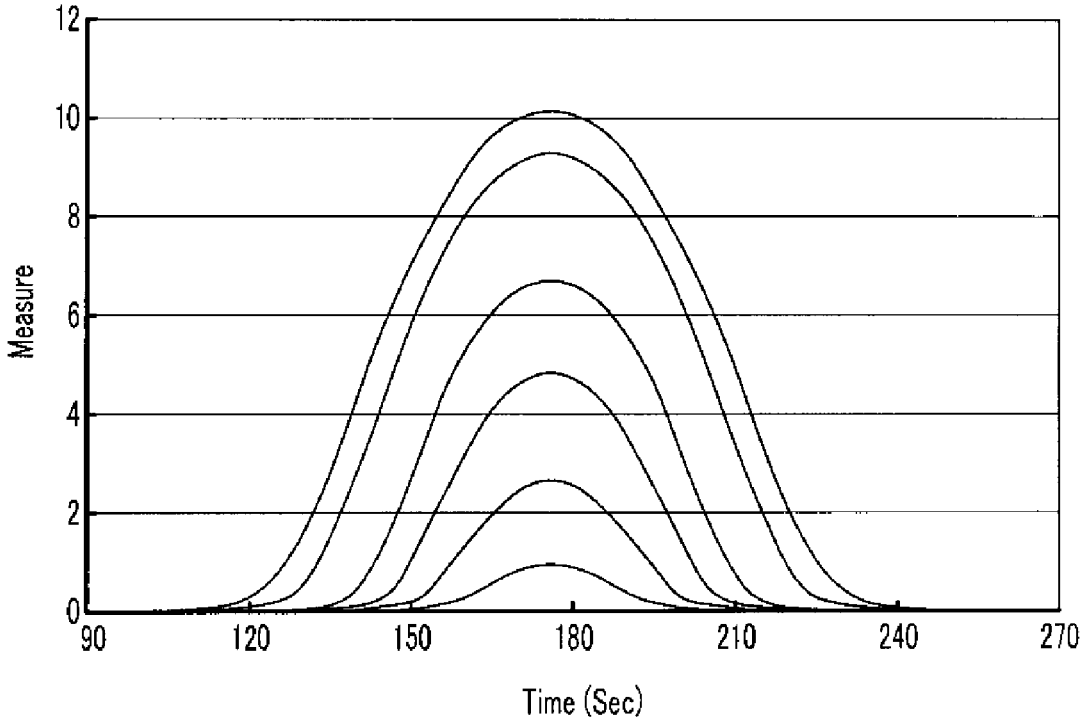
FIG. 10 is a graph showing a profile characteristic of an exemplary variable valve lift apparatus according to the present invention.

FIG. 10 is a graph showing profile characteristics of a variable valve lift apparatus according to various embodiments of the present invention.

Referring to FIG. 10, in low lift mode of the variable valve lift apparatus according to various embodiments of the present invention, the lift change is gentle so that an engine may be easily controlled.

The valve lift characteristic may achieve a mirror design in a "V" type of engine so that the engine may be operated with the rotation direction of camshafts being opposite to each other.

In various embodiments of the present invention, a continuous variable apparatus is provided to realize a mirror design and include a cam carrier so that mass production may be realized without a high cost. The continuous variable valve lift apparatus may use wall portions of a cam carrier, enhance an assembling characteristic thereof, and easily adjust declination of valves.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

an input cam operably connected to an input shaft;

a valve opening unit;

a control shaft disposed in parallel to the input shaft;

an input link rotatably coupled to the control shaft and contacting the input cam;

a control link, one end of which is rotatably coupled to the input link and the other end of which is eccentrically coupled to the control shaft;

a connecting link, one end of which is connected with the other end of the control link; and a lift arm, one end of which is rotatably coupled to the control shaft and the other end of which is rotatably coupled to the other end of the connecting link, the lift arm driving the valve opening unit.

2. The variable valve lift apparatus of claim 1, wherein the input link comprises:

a first member, one end of which is rotatably coupled to the control shaft;

a second member, one end of which is rotatably coupled to the other end of the first member, and the other end of which is rotatably coupled to the other end of the control link; and a roller rotatably coupled to the one end of the second member or the other end of the first member, and contacting the input cam.

3. The variable valve lift apparatus of claim 2, wherein a protrusion portion is formed to the one end of the first member and a lost motion spring is configured to bias the protrusion portion toward the input link for supplying restoring force to the input link.

4. The variable valve lift apparatus of claim 2, wherein the other end of the second member, the other end of the control link, and the one end of the connecting link are coupled by a first connecting pin.

5. The variable valve lift apparatus of claim 2, wherein the other end of the connecting link and the other end of the lift arm are coupled by a second connecting pin.

6. The variable valve lift apparatus of claim 1, further comprising a control portion coupled to the control shaft and controlling rotation angle thereof.

7. The variable valve lift apparatus of claim 6, wherein the control portion comprises a control motor and a worm gear, wherein the worm gear is coupled to an end of the control shaft.

8. The variable valve lift apparatus of claim 1, wherein the one end of the control link comprises an inner race rotatably coupled to inner portion thereof, and rotation center of the inner race is configured to be eccentric with rotation center of the one end of the control link with a predetermined distance.

9. The variable valve lift apparatus of claim 8, wherein the inner race of the control link is connected to the control shaft.

10. An engine comprising the variable valve lift apparatus of claim 1.

11. A passenger vehicle comprising the engine of claim 1.

12. A variable valve lift apparatus comprising:

an input shaft;

an input cam operably connected to the input shaft;

a valve opening unit;

a control shaft disposed in parallel to the input shaft;

a control portion controlling rotation angle of the control shaft;

an input link rotatably coupled to the control shaft and contacting the input cam;

a control link, one end of which is rotatably coupled to the input link and the other end of which is eccentrically coupled to the control shaft;

a connecting link, one end of which is connected with the other end of the control link; and a lift arm, one end of which is rotatably coupled to the control shaft and the other end of which is rotatably coupled to the other end of the connecting link, the lift arm driving the valve opening unit, wherein a cam carrier supports the input shaft and the control shaft.

13. The variable valve lift apparatus of claim 12, wherein the input link comprises;

a first member, one end of which is rotatably coupled to the control shaft;

a second member, one end of which is rotatably coupled to the other end of the first member, and the other end of which is rotatably coupled to the other end of the control link; and a roller rotatably coupled to the one end of the second member or the other end of the first member, and contacting the input cam.

14. The variable valve lift apparatus of claim 13, wherein a protrusion portion is formed to the one end of the first member and a lost motion spring is configured to bias the protrusion portion toward the input link for supplying restoring force to the input link.

15. The variable valve lift apparatus of claim 13, wherein the control portion comprises a control motor and a worm gear wherein the worm gear is coupled to an end of the control shaft.

16. The variable valve lift apparatus of claim 12, wherein the one end of the control link comprises an inner race rotatably coupled to inner portion thereof, and rotation center of the inner race is configured to be eccentric with rotation center of the one end of the control link with a predetermined distance.

17. The variable valve lift apparatus of claim 16, wherein the inner race of the control link is connected to the control shaft.

18. The variable valve lift apparatus of claim 13, wherein a first wall portion is formed to the cam carrier, and the input link, the control link, and the connecting link are connected by the first connecting pin, wherein the first connecting pin is disposed bear to the first wall portion and thus prevented from separation by the first wall portion.

19. The variable valve lift apparatus of claim 13, wherein a second wall portion is formed to the cam carrier, and the connecting link and the lift arm are connected by the second connecting pin, wherein the second connecting pin is disposed near to the second connecting pin and thus prevented from separation by the second connecting pin.

20. An engine comprising the variable valve lift apparatus of claim 12.

* * * * *